US009169608B1

(12) United States Patent
DeVilliers, Jr.

(10) Patent No.: US 9,169,608 B1
(45) Date of Patent: Oct. 27, 2015

(54) VEHICLE TIRE DEFLATION SYSTEM

(71) Applicant: Henry L. DeVilliers, Jr., San Antonio, TX (US)

(72) Inventor: Henry L. DeVilliers, Jr., San Antonio, TX (US)

( * ) Notice: Subject to any disclaimer, the term of this patent is extended or adjusted under 35 U.S.C. 154(b) by 0 days.

(21) Appl. No.: 13/802,623

(22) Filed: Mar. 13, 2013

Related U.S. Application Data

(60) Provisional application No. 61/610,419, filed on Mar. 13, 2012.

(51) Int. Cl.
*E01F 13/12* (2006.01)

(52) U.S. Cl.
CPC ..... *E01F 13/12* (2013.01)

(58) Field of Classification Search
CPC ..... E01F 13/12
USPC ..... 404/6; 49/49
See application file for complete search history.

(56) References Cited

U.S. PATENT DOCUMENTS

| | | | | | |
|---|---|---|---|---|---|
| 5,253,950 | A * | 10/1993 | Kilgrow et al. | ..... | 404/6 |
| 5,536,109 | A * | 7/1996 | Lowndes | ..... | 404/6 |
| 5,538,358 | A * | 7/1996 | Scrimshaw | ..... | 404/6 |
| 5,588,774 | A * | 12/1996 | Behan | ..... | 404/6 |
| 5,890,832 | A * | 4/1999 | Soleau | ..... | 404/6 |
| 6,048,128 | A * | 4/2000 | Jones et al. | ..... | 404/6 |
| 6,312,189 | B1 * | 11/2001 | Marphetia | ..... | 404/6 |
| 6,357,961 | B1 * | 3/2002 | Marphetia | ..... | 404/6 |
| 7,025,526 | B2 * | 4/2006 | Blair | ..... | 404/6 |
| 7,037,032 | B1 * | 5/2006 | Marphetia | ..... | 404/6 |
| 7,850,392 | B2 * | 12/2010 | Schubert | ..... | 404/6 |
| 2012/0243935 | A1 * | 9/2012 | Spencer et al. | ..... | 404/6 |

* cited by examiner

*Primary Examiner* — Thomas B Will
*Assistant Examiner* — Katherine Chu
(74) *Attorney, Agent, or Firm* — Wayne J. Colton, Inc.

(57) ABSTRACT

A vehicle tire deflation system includes a number of spike carrying members operably interconnected to an equal number of base members to form an accordion style vehicle tire deflation system. The vehicle tire deflation system includes an arrangement for ensuring the that the vehicle tire deflation system may be effectively utilized whether deployed right side up or upside down and a mechanism for ensuring that the vehicle tire deflation system remains in its extended configuration upon deployment in use.

2 Claims, 10 Drawing Sheets

VEHICLE TIRE DEFLATION SYSTEM

RELATED APPLICATION

This present application claims, under 35 U.S.C. §119(e), all available benefit of and priority to U.S. provisional patent application Ser. No. 61/610,419 filed Mar. 13, 2012. By this reference, the full disclosure, including the drawings, of U.S. provisional patent application Ser. No. 61/610,419 is incorporated herein as though now set forth in its entirety.

FIELD OF THE INVENTION

The present invention relates to law enforcement. More particularly, the invention relates to an accordion style vehicle tire deflation system wherein the vehicle tire deflation system is particularly adapted for effective operation without requirement for post deployment adjustment, even in cases where the system is inadvertently deployed upside down.

BACKGROUND OF THE INVENTION

Accordion style vehicle stop sticks are generally known in the relevant arts to exhibit various advantages over linear style stop sticks. Unfortunately, however, in order to ensure effective operation against a target vehicle the known accordion style stop sticks must be carefully deployed in order to ensure that the stop stick is right side up. Because in at least some circumstances, the press of time or other environmental and/or officer safety issues result in such a stop stick being inadvertently deployed upside down, generally resulting in a missed opportunity to stop the offending vehicle. Additionally, the known accordion style stop sticks are also generally prone to snapping back upon deployment, causing the expanded stop stick to contract and, as a consequence, reducing the available length of stop stick and also often resulting in missed opportunity to stop the offending vehicle.

Still further, when either of these situations occurs, a deploying officer may attempt to perform post deployment adjustment of the incorrectly deployed stop stick. Unfortunately, such behavior causes the officer to be exposed to traffic and, in many cases, has resulted in serious injury and even fatality. As a result, it is an overriding object of the present invention to improve over the prior art by teaching an accordion style vehicle tire deflation system that is particularly adapted for effective operation regardless of whether the stop stick is deployed right side up or upside down and that is also generally impervious to inadvertent post deployment collapses.

SUMMARY OF THE INVENTION

In accordance with the foregoing objects, the present invention—a vehicle tire deflation system—generally comprises a plurality of spike carrying members operably interconnected to an equal plurality of base members to form an accordion style vehicle tire deflation system. The vehicle tire deflation system includes means for ensuring the that the vehicle tire deflation system may be effectively utilized whether deployed right side up or upside down and/or means for ensuring that the vehicle tire deflation system remains in its extended configuration upon deployment in use.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
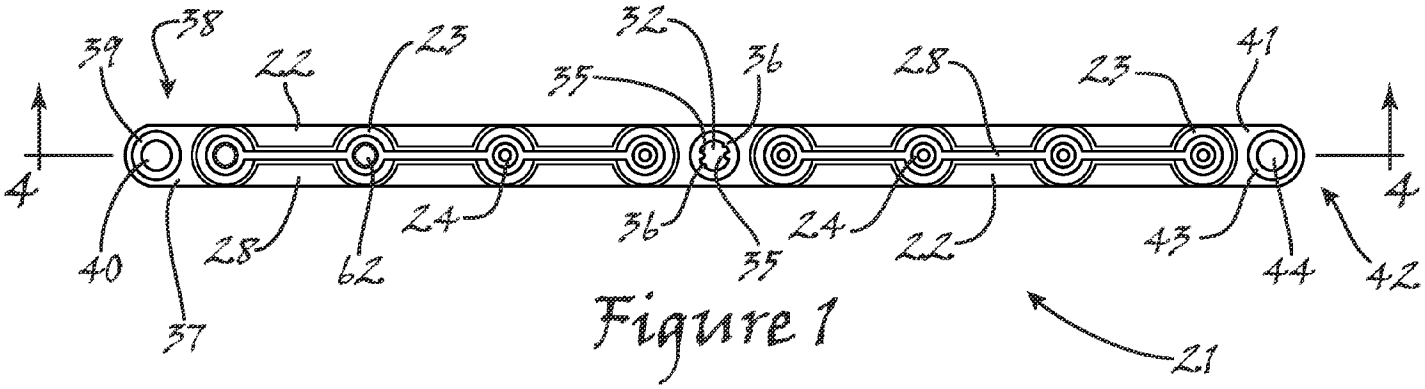
FIG. 1 shows, in a top plan view, a spike carrying member as utilized in the preferred implementation of the vehicle tire deflation system of the present invention.
Figure 2:
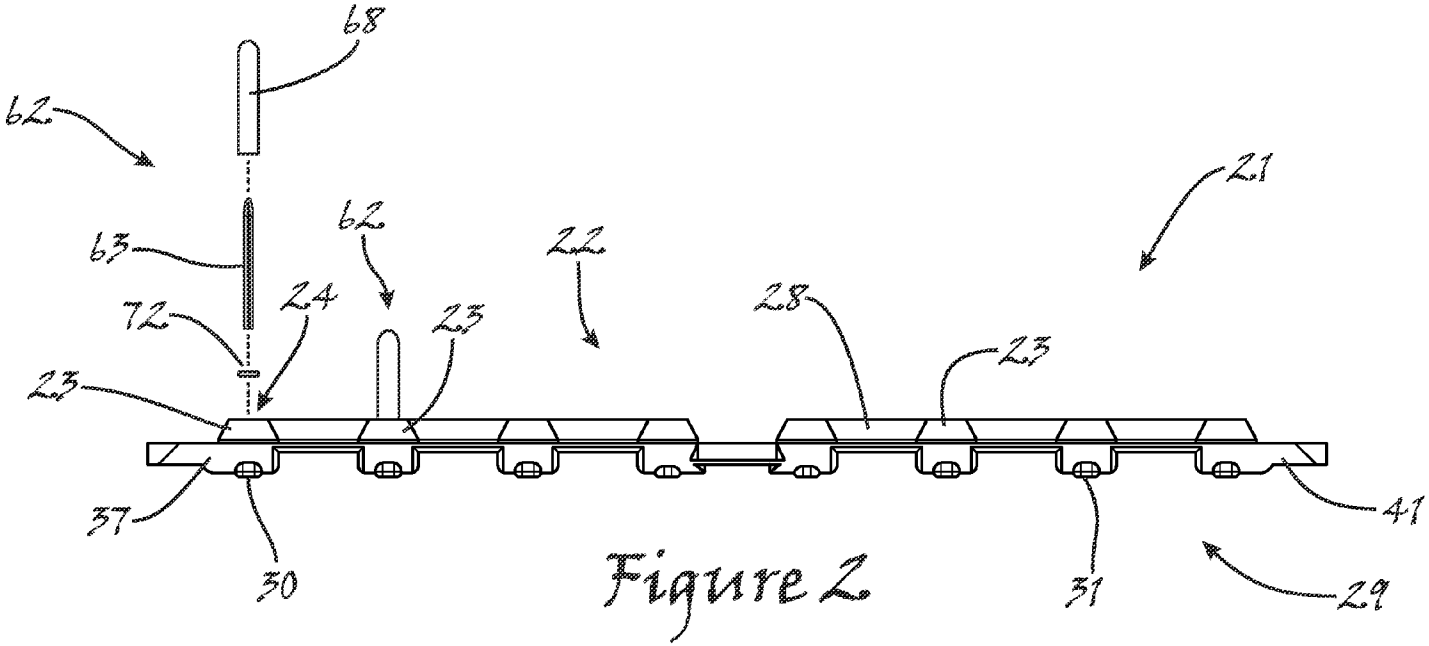
FIG. 2 shows, in a partially exploded side elevational view, the spike carrying member of FIG. 1 and, in particular, shows various details of the manner of loading the spike carrying member with spike assemblies.
Figure 3:
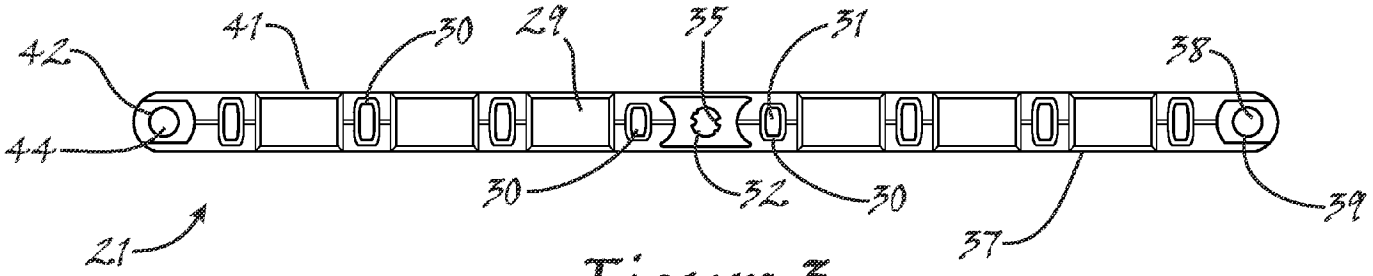
FIG. 3 shows, bottom plan view, the spike carrying member of FIG. 1.
Figure 4:
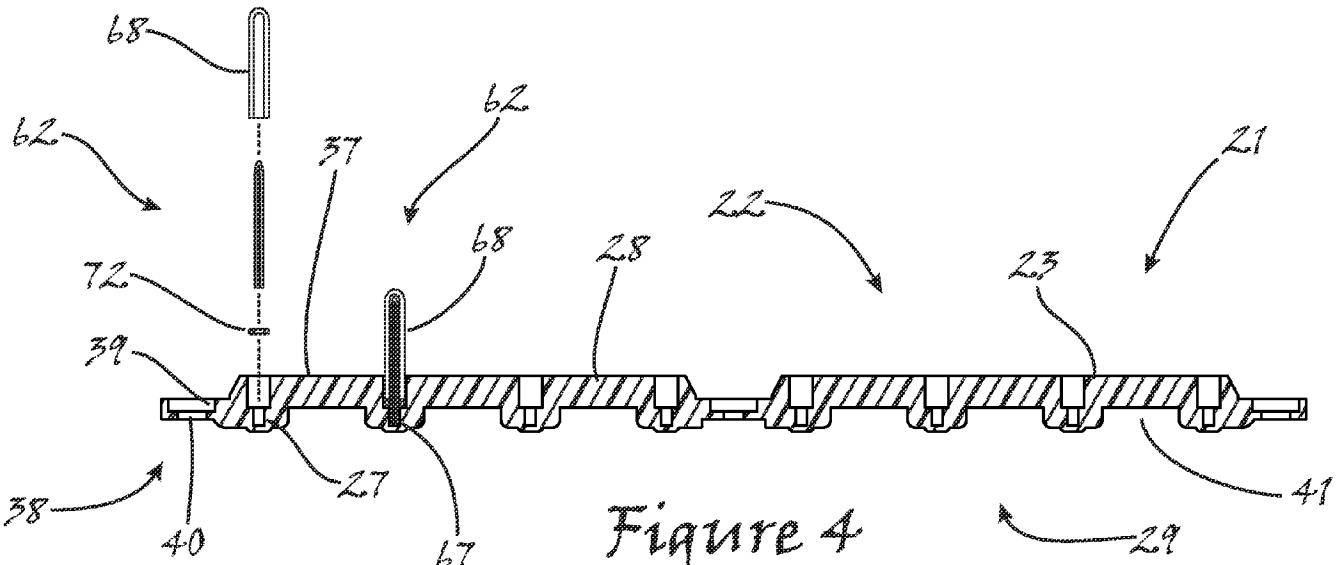
FIG. 4 shows, in a cross sectional view taken through section line 4-4 of FIG. 1, various additional details of the spike carrying member of FIG. 1.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, the vehicle tire deflation system 20 of the present invention is shown to generally comprise a plurality of spike carrying members 21 operably interconnected to an equal plurality of base members 45 to form an accordion style vehicle tire deflation system, sometimes called a "stop stick." As will be better understood further herein, however, the vehicle tire deflation system 20 of the present invention differs from the known accordion style vehicle tire deflation systems in the provision of: (1) a novel means for ensuring the that the vehicle tire deflation system 20 of the present invention may be effectively utilized whether deployed right side up or upside down and (2) a novel means for ensuring that the vehicle tire deflation system 20 of the present invention remains in its extended configuration upon deployment in use. As will be appreciated by those of ordinary skill in the art, especially upon further review of this exemplary description, each of these features contributes to minimizing if not eliminating the very dangerous practice of making post deployment adjustments to accordion style vehicle tire deflation systems, thereby resulting in dramatically increased officer safety.

Referring now to FIGS. 1 through 5, in particular, each spike carrying member 21 of the preferred implementation of the vehicle tire deflation system 20 of the present invention is shown to comprise an elongate body, preferably manufactured by injection molding of polyamide 66, having disposed on the top side 22 thereof a plurality of upwardly projecting spike receptacles 23. As shown in the figures, each provided spike receptacle 23 comprises a generally cylindrical, stepped cavity 24 wherein an interior shoulder 25 separates a slightly narrower bottom portion 26 from the upper portion of the cavity 24. In order to ensure durability in use, several of the provided spike receptacles 23 are preferably interconnected by reinforcing gussets 28 therebetween. Additionally, in order to provide stability in use, the bottom of each spike carrying member 21 is provided with a plurality of feet 30, each having a substantially planar bottom surface 31. In a critical aspect of the novel means for ensuring the that the vehicle tire deflation system 20 of the present invention may be effectively utilized whether deployed right side up or upside down, each provided foot 30 is disposed on the bottom 29 of the spike carrying member 21 adjacent to the base 27 of the bottom portion 26 of a spike receptacle 23 such that if the vehicle tire deflation system 20 should be inadvertently deployed upside down a tire deflation spike 63 may pierce through the material of the spike carrying member 21 and through the corresponding foot 30.

Figure 5:
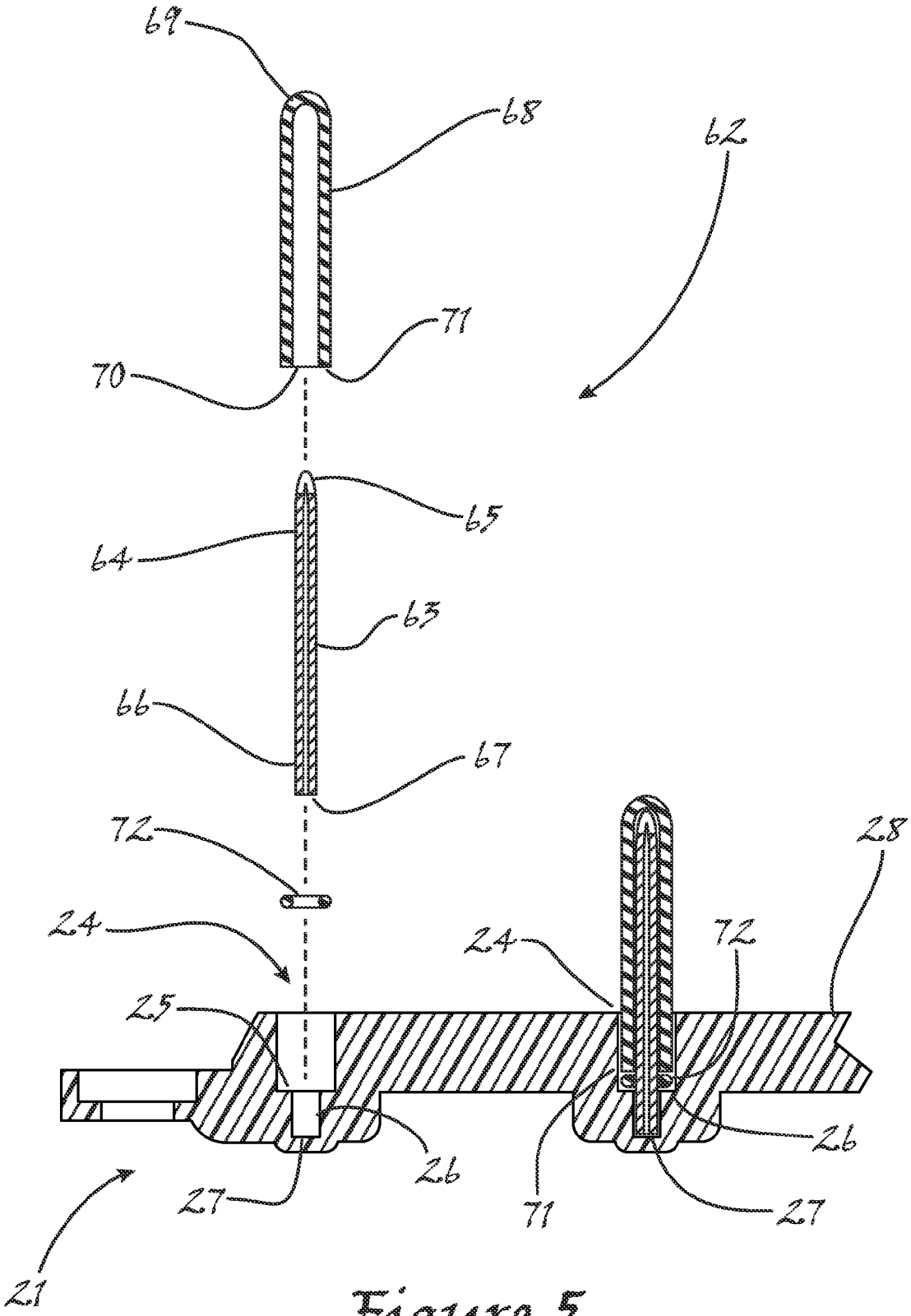
FIG. 5 shows, in a detail view of the leftmost portion of the depiction of FIG. 4, still further details of the spike carrying member of FIG. 1.
Figure 6:
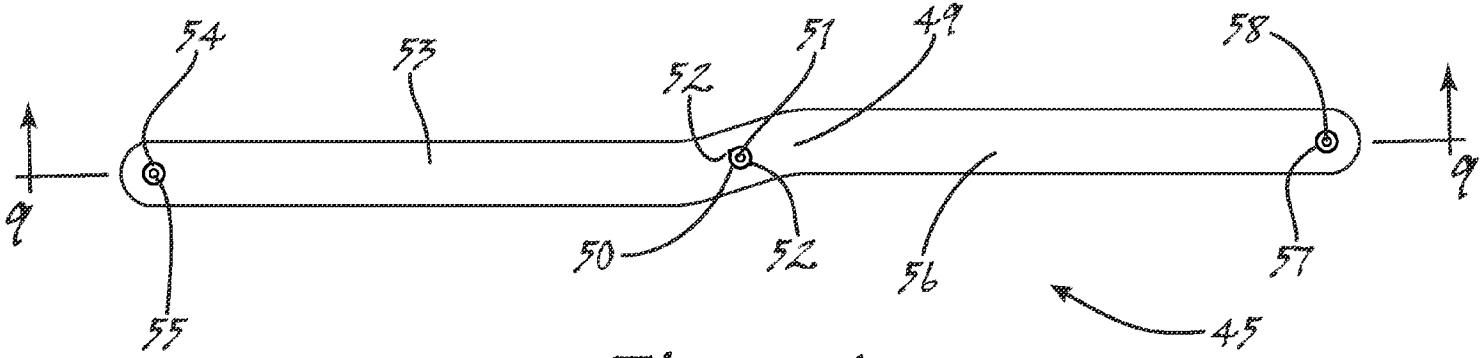
FIG. 6 shows, in a top plan view, a base member utilized in the preferred implementation of the vehicle tire deflation system of the present invention.
Figure 7:
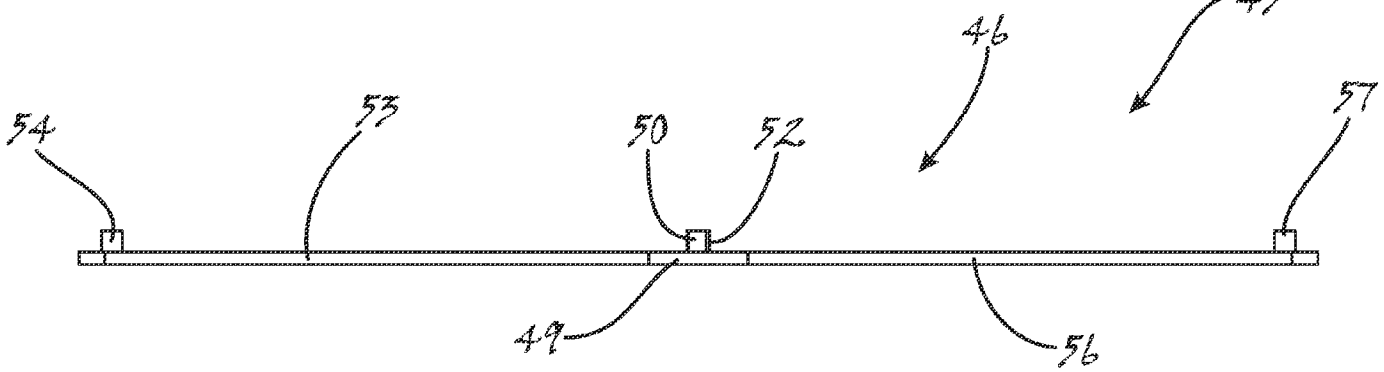
FIG. 7 shows, in a side elevational view, the base member of FIG. 6.
Figure 8:
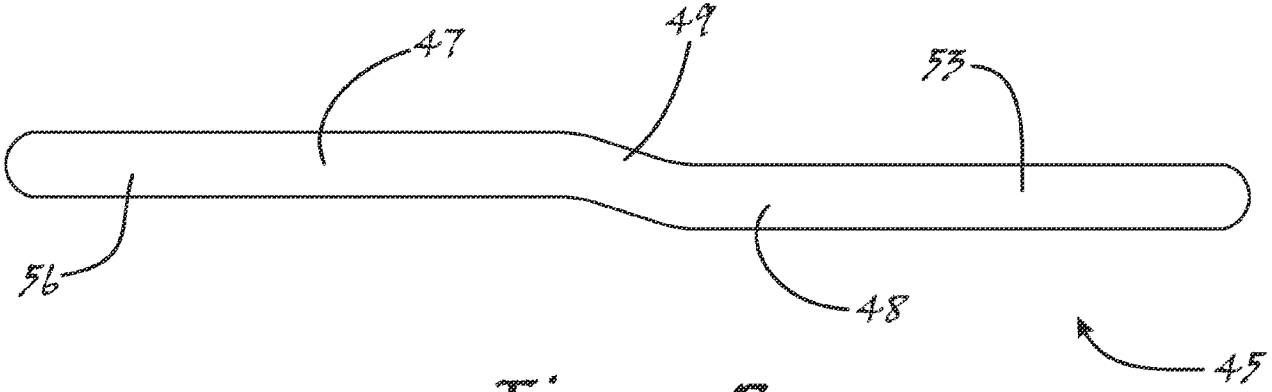
FIG. 8 shows, in a bottom plan view, the base member of FIG. 6.
Figure 9:
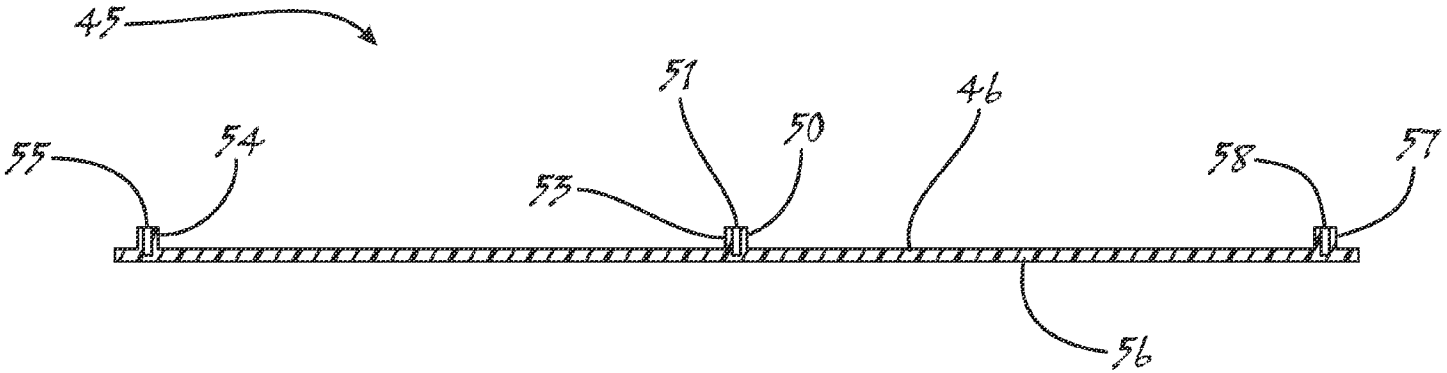
FIG. 9 shows, in a cross sectional view taken through section line 9-9 of FIG. 6, various additional details of the base member of FIG. 6.

In any case, prior to deployment for use, each upwardly projecting spike receptacle 23 is fitted with a spike assembly 62. As particularly detailed in FIG. 5, each spike assembly 62 generally comprises a tire deflation spike 63, a preferably rubber cap 68 and a rubber, silicone or like material O-ring 72. As shown in the figure, the O-ring 72 fits snuggly within the stepped cavity 24 of a spike receptacle 23 and, in use, rests upon the shoulder 25 of the cavity 24. With the O-ring 72 in place, a tire deflation spike 63 is inserted through the O-ring 72 into the cavity 24. As shown in FIG. 5, and in an aspect deemed critical to the invention of the means for ensuring the that the vehicle tire deflation system 20 of the present invention may be effectively utilized whether deployed right side up or upside down, the tire deflation spikes 63 as utilized in the present invention generally comprise a top end 64 having a bevel 65 such that the top end 64 is generally sharper than the bottom end 66 of the tire deflation spike, which as shown in the figure comprises a generally flat base 67. Additionally, as also shown in the figure, the tire deflation spikes 63 are also formed to have a hollow interior and, most preferably, comprise steel roll pin material that has been shaped as previously described. Finally, the open bottom 70 of the preferably rubber cap 68 is then slid over the inserted tire deflation spike 63 such that the edge 71 about the bottom 70 of the cap 68 rests atop the O-ring 72 with the cap 68 snuggly fitted into the upper portion of the cavity 24 and the beveled, top end 64 of the tire deflation spike 63 adjacent the inside of the top 69 of the cap 68.

As will be appreciated by those of ordinary skill in the art with the benefit of this exemplary detailed description, in ordinary "right side up" use a tire running over a spike assembly 62 will cause the contained spike 63 to easily pierce through the top 69 of the cap 68 and into the tire, causing deflation thereof. Additionally, as also will be appreciated by those of ordinary skill in the art with the benefit of this exemplary detailed description, in the event that the vehicle tire deflation system 20 of the present invention should be inadvertently deployed in the "upside down" position, the beveled, top end 64 of the tire deflation spike 63 will embed slightly into the pavement below, but because of the loose coupling provided by the O-ring 72 and the proximity between the base 27 of the bottom portion 26 of the cavity 24 and the bottom surface 31 of the adjacent foot 30, the generally flat base 67 at the bottom end 66 of the tire deflation spike 63 will pierce through the adjacent foot 30 and into the tire, causing deflation thereof.

As also shown in the figures, each spike carrying member 21 is generally divided by a central eyelet 32 into a first half 37 and a second half 41. As will be better understood further herein, the central eyelet 32 of each spike carrying member 21 generally comprises a cylindrical borehole 34 having at the top side thereof a preferably cylindrical countersink 33. In an aspect that will further herein be understood to be critical to the novel means for ensuring that the vehicle tire deflation system 20 of the present invention remains in its extended configuration upon deployment in use, the borehole 34 of each central eyelet 32 further comprises at least one, and preferably two, stops 35 and at least one, and preferably two, backstops 36.

Finally, as also shown in the figures, a first distal eyelet is 38 is provided at the end of the first half 37 of the spike carrying member 21 for use in connecting the spike carrying member 21 to an adjacently provided base member 45. As shown, each first distal eyelet 38 is formed with a smooth borehole 40 having a preferably cylindrical countersink 39. Likewise, a second distal eyelet 42 is provided at the end of the second half 41 of the spike carrying member 21 for use in connecting the spike carrying member 21 to another adjacently provided base member 45. As shown, each second distal eyelet 42 is also formed with a smooth borehole 44 having a preferably cylindrical countersink 43.

Turning then to FIGS. 6 through 9, in particular, each base member 45 of the preferred implementation of the vehicle tire deflation system 20 of the present invention is shown to comprise an elongate body, preferably manufactured by injection molding of polyamide 66, having a substantially flat surface 48 for a bottom 47 and having disposed on the top side 46 thereof a plurality of upwardly projecting posts 50, 54, 57 adapted for interconnection of the base member 45 with up to three separate spike carrying members 21. In order to accommodate the desired accordion geometry, each base member 45 comprises a central offset 49, as shown in the figures, generally diving the base member into a first half 53 and a second half 56. A central post 50, having at least one, but preferably two counter-stops 52 is provided at the central offset 49. Additionally, a first distal post 54 is disposed at the end of the first half 53 and a second distal post 57 is provided at the end of the second half 56. Finally, as particularly shown in FIG. 9, each post 50, 54, 57 is provided with a screw hole 51, 55, 58, respectively.

Figure 10:
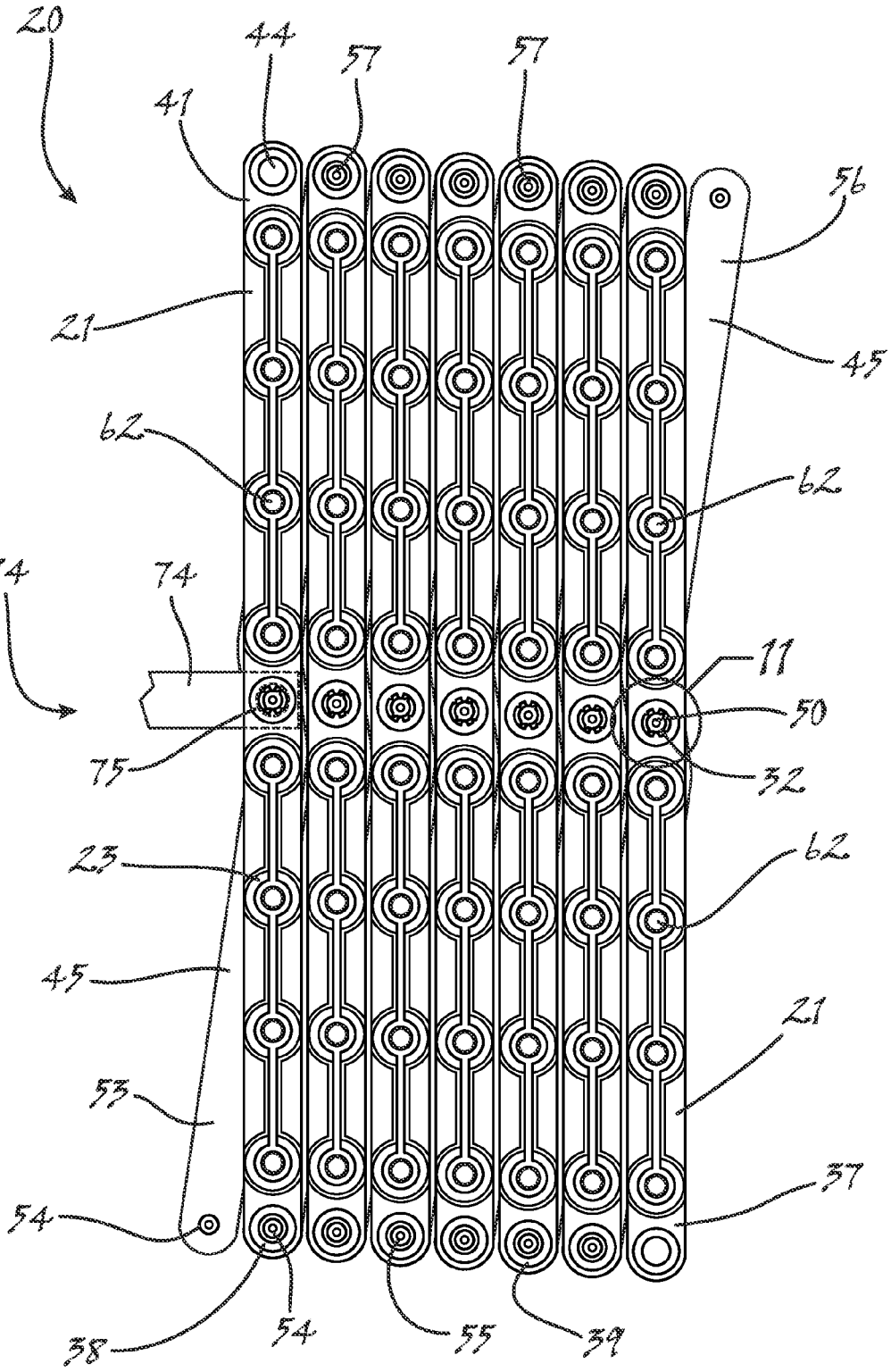
FIG. 10 shows, in a top plan view, the preferred implementation of the vehicle tire deflation system of the present invention as partially assembled for use.

In assembly of the preferred implementation of the vehicle tire deflation system 20 of the present invention, a plurality of spike carrying members 21 and an equal plurality of base members 45 are first arranged as shown in detail in FIG. 10. As shown in FIG. 10, this arrangement also preferably included providing a retrieval system 73, as generally known in the art, such as a strap 74 with connecting hole 75 or a like cord, cable, lanyard or the like. In any case, with the spike carrying members 21 and base members 45 arranged as shown in FIG. 10, including the retrieval system 73, the various spike carrying members 21 and base members 45 are fastened together using conventional connecting hardware 59 such as the depicted machine screws 60 and flat washers 61.

Figure 11:
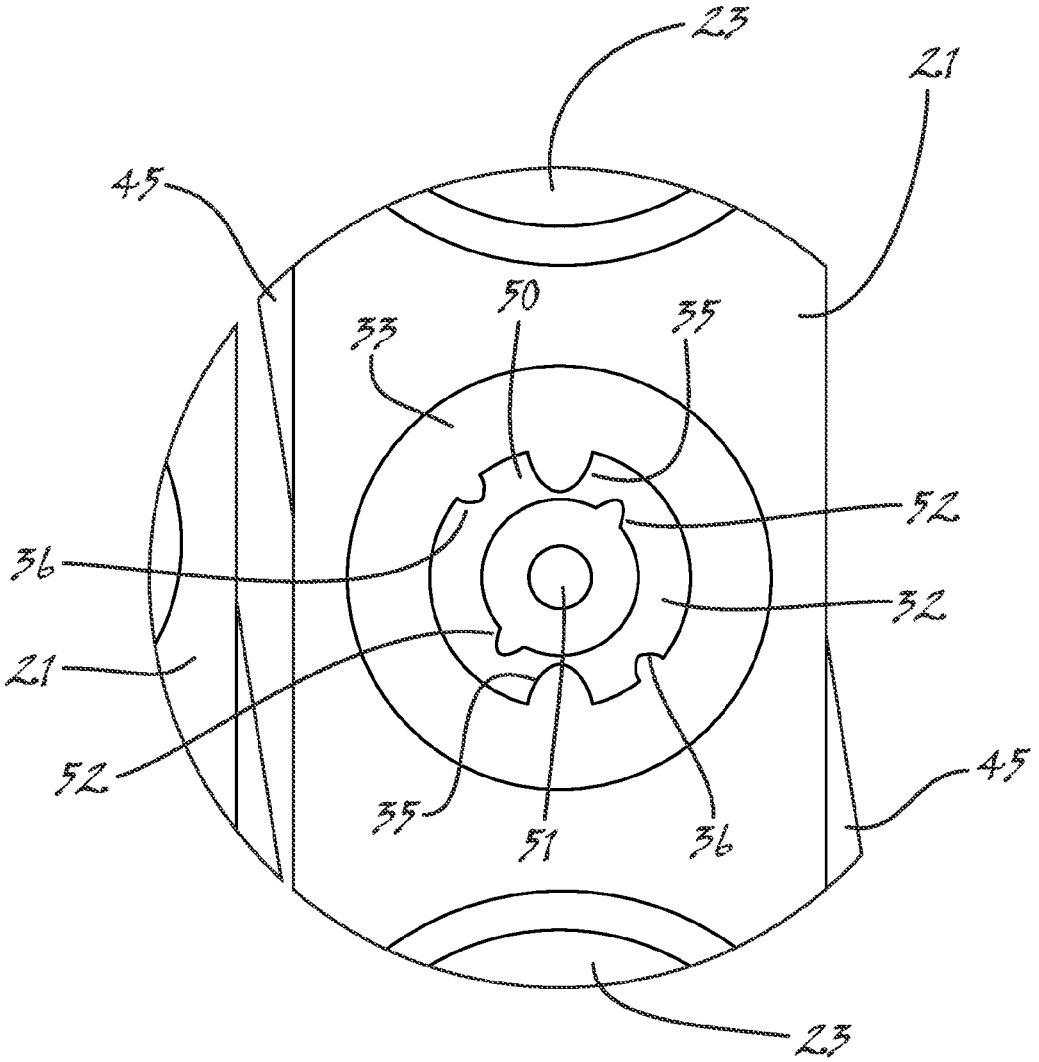
FIG. 11 shows, in a detail view identified by reference "11" in FIG. 10, details of the provision in the present invention of an anti-snap back feature.
Figure 12:
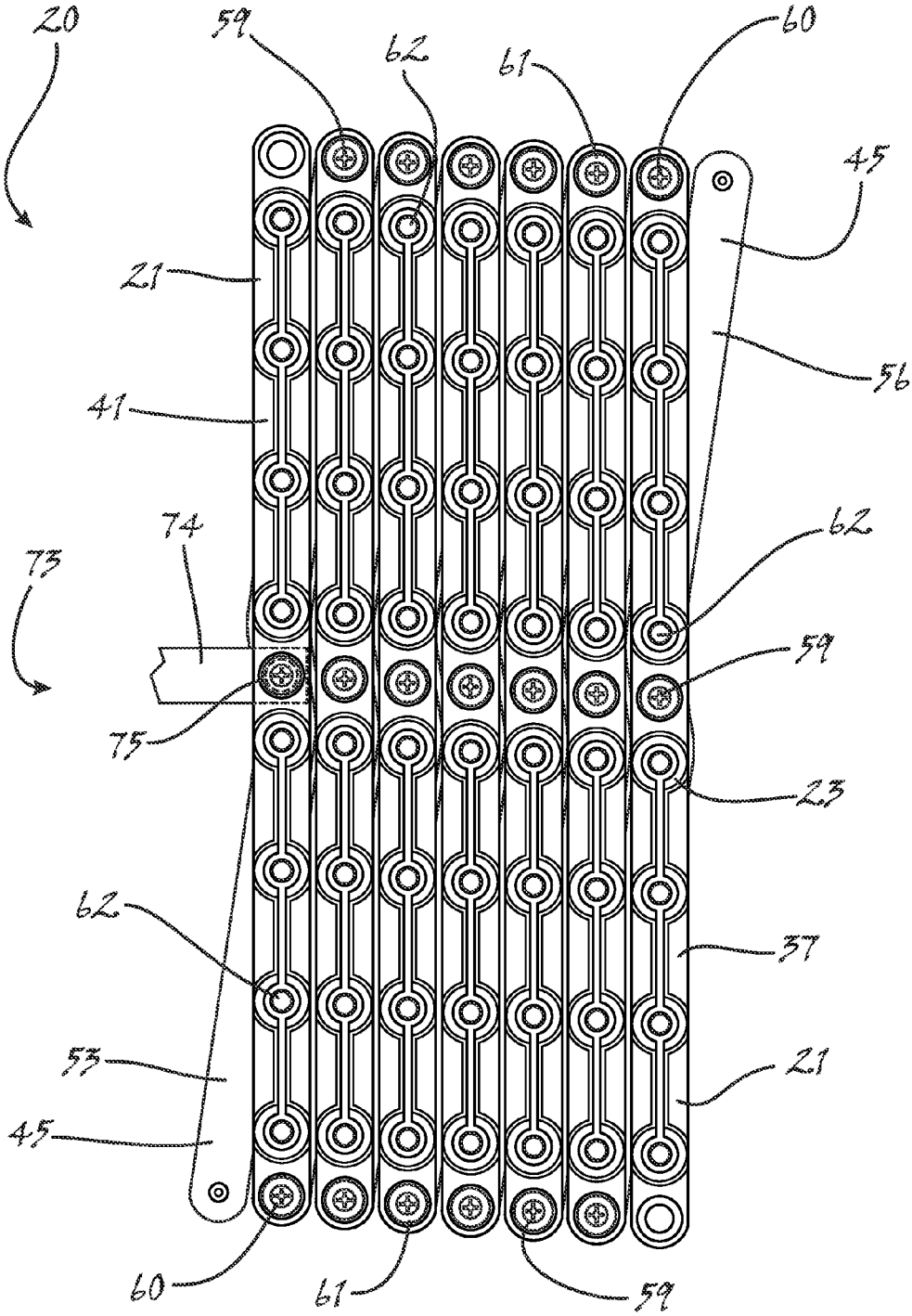
FIG. 12 shows, in a top plan view generally corresponding to the view of FIG. 10, the preferred implementation of the vehicle tire deflation system of the present invention as fully assembled for use.
Figure 13:
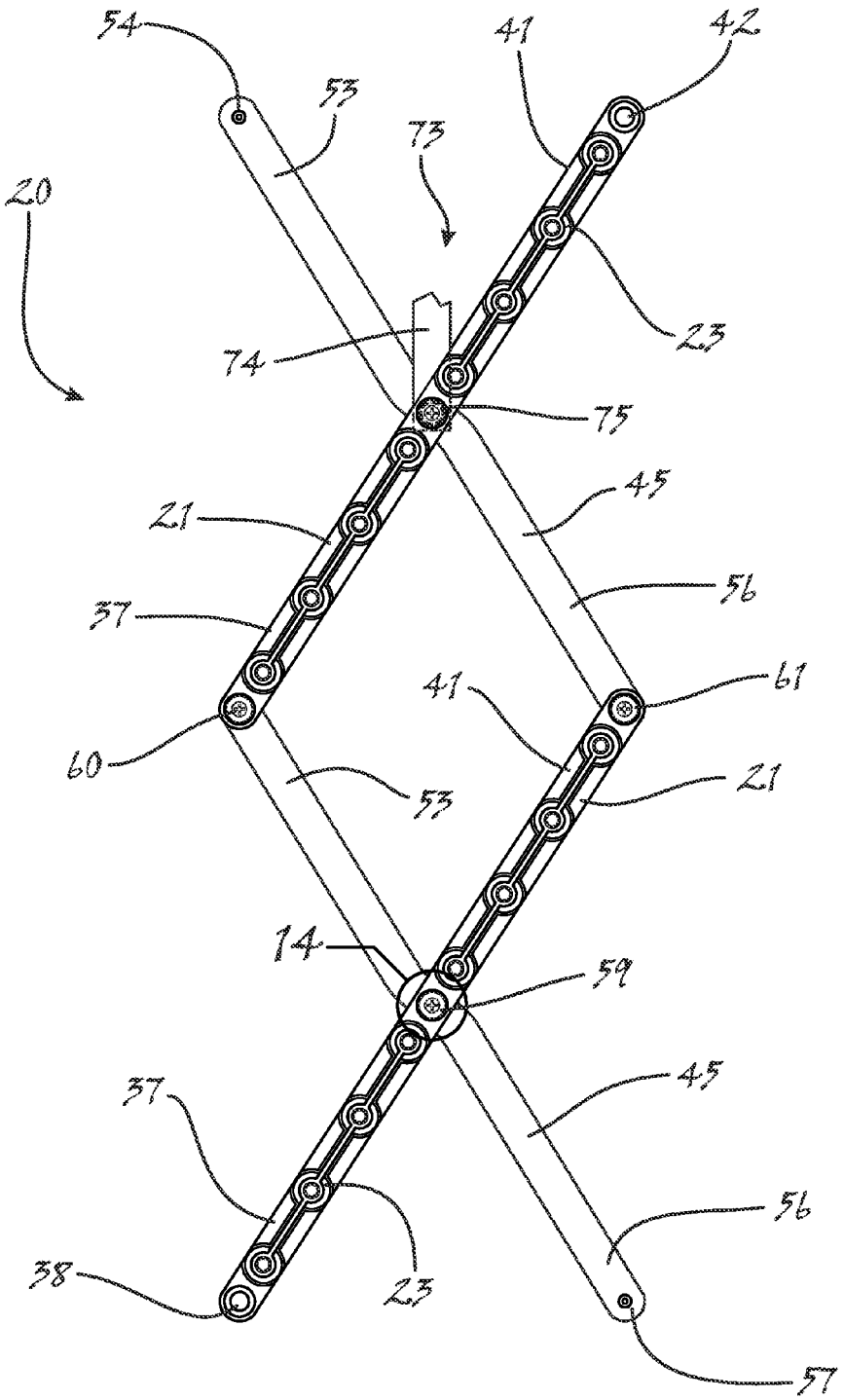
FIG. 13 shows, in a top plan view, several sections of the assembled vehicle tire deflation system of FIG. 12 as positioned following deployment in use.
Figure 14:
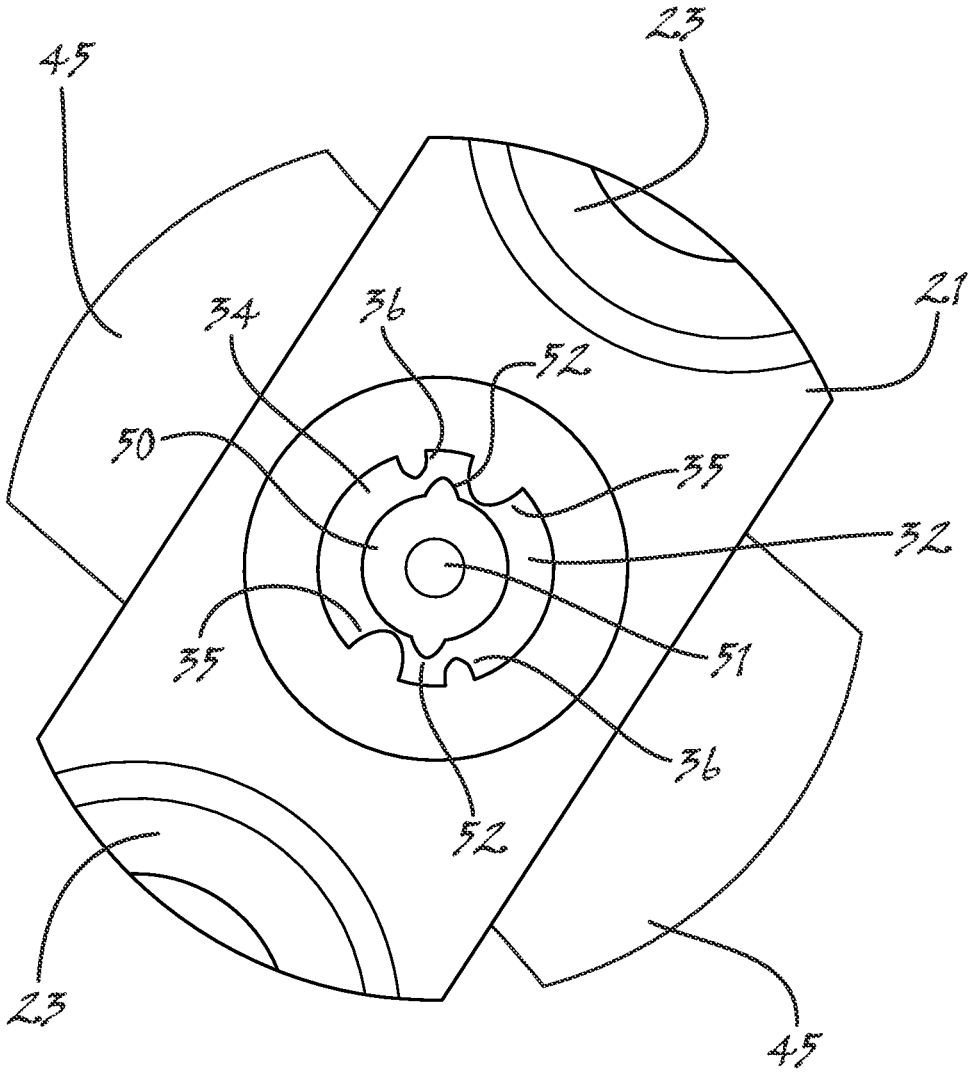
FIG. 14 shows, in a detail view identified by reference "14" in FIG. 13, additional details of the provision in the present invention of the anti-snap back feature.

In use, an officer deploys the vehicle tire deflation system 20 of the present invention by grasping the retrieval system 73 with one hand while tossing the vehicle tire deflation system 20 away from him or herself, causing the accordion structure of the tire deflation system 20 to expand as depicted in FIG. 13. As will be appreciated by those of ordinary skill in the art upon review of FIGS. 11 and 14, however, the described deployment is controlled by the novel means for ensuring that the vehicle tire deflation system 20 of the present invention remains in its extended configuration. In particular, as shown in the figures, as the accordion structure of the vehicle tire deflation system 20 of the present invention reaches its deployed state, the counter-stops 52 of the central posts 50 of each base member 45 contact the corresponding stops 35 of the central eyelets 32 of the interconnected spike carrying members 21. As the counter-stops 52 pass over the adjacent backstops 36, friction cushions and slows the final impact and, additionally, should the vehicle tire deflation system 20 begin to snap back the second contact of the counter-stops 52 with the adjacent backstops 36 will be sufficient to prevent collapse of the vehicle tire deflation system 20.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A vehicle tire deflation system, said vehicle tire deflation system comprising:

a plurality of spike carrying members;

a plurality of base members, interconnected with said spike carrying members; and a recoil suppression mechanism for preventing collapse of said vehicle tire deflation system during deployment thereof, said recoil suppression mechanism comprising:

a post disposed on one of said base members, said post having at least one counter-stop formed thereon;

an eyelet disposed on one of said spike carrying members, corresponding to said one of said base members, said eyelet having at least one backstop and at least one stop formed therein; and wherein said counter-stop, said back-stop and said stop are sized and arranged such that;

said backstop allows said counter-stop to rotate past said backstop as the tire deflation system is expanded in deployment; said stop then blocks further rotation of said counter-stop; and in the event that said counter-stop recoils back from said stop during deployment, said backstop blocks the recoil rotation of said counter-stop to prevent inadvertent collapse of the tire deflation system after deployment.

2. The vehicle tire deflation system as recited in claim 1, wherein:

said post has a plurality of counter-stops formed thereon; and said eyelet has a plurality of backstops and a plurality of stops formed therein.

* * * * *